United States Patent [19]

Gueret et al.

[11] 4,213,472

[45] Jul. 22, 1980

[54] FINGER MOUNTABLE MAKEUP APPLICATOR

[75] Inventors: Jean-Louis H. Gueret, Paris, France; Nancy Adams, Westport, Conn.

[73] Assignee: L'Oreal, Paris, France

[21] Appl. No.: 930,856

[22] Filed: Aug. 3, 1978

[51] Int. Cl.[2] ..... A45D 40/26

[52] U.S. Cl. ..... 132/88.7; 15/210 R; 401/130

[58] Field of Search ..... 132/88.5, 88.7, 1; 15/210 R, 244, 104.94, 227; 401/7, 8, 124, 125, 130

[56] References Cited

U.S. PATENT DOCUMENTS

| | | | |
|---|---|---|---|
| 2,360,457 | 10/1944 | Wells | 132/88.7 |
| 2,461,221 | 2/1949 | Margulies | 401/7 |
| 3,226,754 | 1/1966 | Brittain | 401/130 |

FOREIGN PATENT DOCUMENTS

| | | | |
|---|---|---|---|
| 2147451 | 4/1972 | Fed. Rep. of Germany | 132/88.7 |
| 2337972 | 2/1975 | Fed. Rep. of Germany | 15/104.94 |
| 12488 | of 1892 | United Kingdom | 15/227 |

*Primary Examiner*—Jay N. Eskovitz

*Attorney, Agent, or Firm*—Brisebois & Kruger

[57] ABSTRACT

A makeup applicator having a body including arcuate shells with projecting tips joined together to form a hinged connection for the shells. The projecting tips receive a makeup applicator element which can be of a desired form. The hinged connection urges the shells toward each other to resiliently grip the finger tip of the user inserted between the shells.

10 Claims, 13 Drawing Figures

Fig. 1
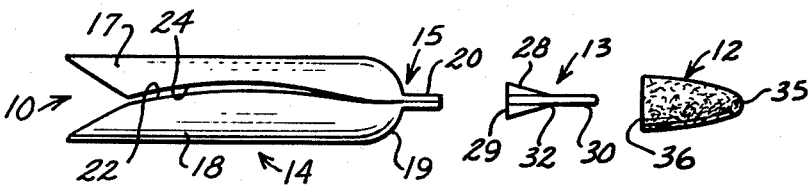
Fig. 5
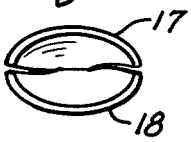
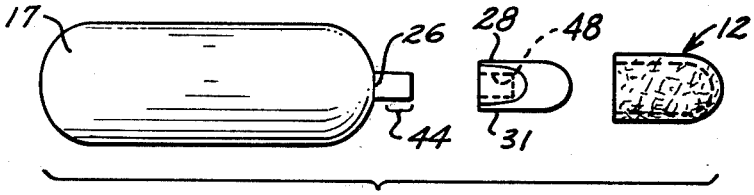
Fig. 2
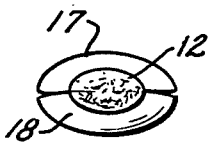
Fig. 6
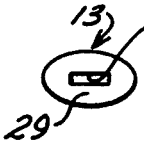
Fig. 7
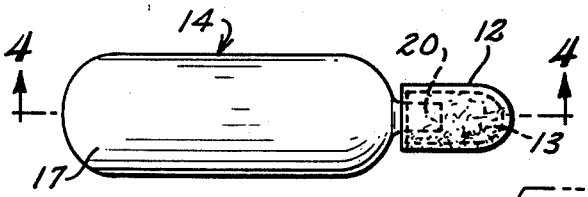
Fig. 3
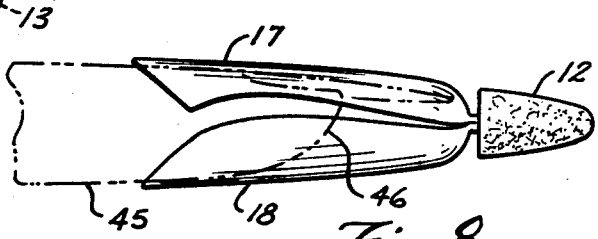
Fig. 8
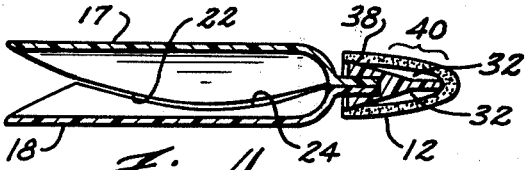
Fig. 4
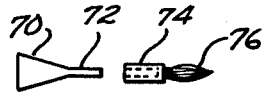
Fig. 12
Fig. 9
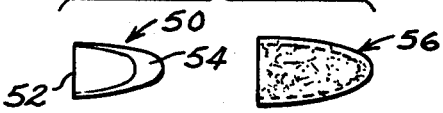
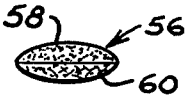
Fig. 11
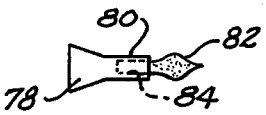
Fig. 13
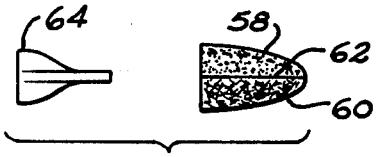
Fig. 10

FINGER MOUNTABLE MAKEUP APPLICATOR

SUMMARY OF THE INVENTION

This invention relates generally to a makeup or cosmetic applicator for mounting on the finger of the user, and particularly to a unique makeup applicator which protects the finger of the user from being soiled by the makeup, yet permits effective application of the makeup by mounting the applicator so that an element at the end of the applicator is spaced from and forms an extension of the user's finger.

Makeup applicators for mounting on one's finger are not per se new. Various types of such applicators are shown and described in the following U.S. patents which constitute the prior art applicants are aware of:

U.S. Pat. No. 2,002,144—Heaton

U.S. Pat. No. 2,096,858—Purcell

U.S. Pat. No. 3,226,754—Brittain

U.S. Pat. No. 3,505,700—Rodriguez.

However, none of the makeup applicators in the above patents are wholly effective.

At present, finger mounted makeup applicators are not in wide use. The conventional manner of applying makeup at present is with a brush or pad mounted on a handle or stem so that the applicator brush or pad extends beyond the ends of the user's fingers which grip the handle. Such handles are usually quite thin and difficult to grasp. However, as a result of the use of these applicators over a period of years, people have become accustomed to applying makeup from an applicator which projects at least one-half inch beyond the finger or fingers which hold the applicator. Similarly, in the case of lipstick, the lipstick extends somewhat beyond the fingers of the user which hold the lipstick tube when the lipstick is applied.

As a result of the extensive use of such known handle type makeup applicators, the users of such applicators have become accustomed to using an applicator which projects somewhat from the user's fingers which grip it when in use.

In the prior art mentioned above, the applicators disclosed, while being mountable on the finger of the user, have been found not to be wholly effective. In some instances, the makeup brush or applicator is so close to the tip of the finger that one who previously used a brush found it difficult to manipulate an applicator located at or a very short distance from the fingertip. In addition, these prior applicators which fit on the finger are not wholly effective in protecting the finger from being soiled by the cosmetic product. In some instances, the applicator itself has an opening completely through it, and the applicator pad is so large and bulky, that the unused cosmetic on the applicator pad is wasted by being absorbed into or drying on the applicator pad. In another construction of the above patents, the applicator is a finger cot completely mounted on and wholly covering the tip of the finger, but is relatively thin, so that it is, in essence, an applicator element at the tip of the finger which applies the cosmetic. Such construction is unsatisfactory because the makeup cannot be applied with precision from the rather blunt rounded applicator surface which corresponds in configuration to the fingertip.

Correspondingly, there is a need for an inexpensive wholly effective makeup applicator which is easy to use, has its makeup applicator surface at the same distance from the finger as the customary makeup brush, is easy to mount on one's finger, and effectively protects the finger against soiling by maintaining the applicator pad spaced from the fingertip of the user.

In accordance with this invention, such a finger mounted makeup applicator is provided. The applicator includes a holder in the form of opposed elongated shell portions joined together adjacent one end to provide a substantially closed end, the shell portions being formed from a flexible material with resilient characteristics and which is inert to the cosmetic to be applied with the applicator. Each shell diverges from its closed end and is preferably arcuate so that a finger of the user can be inserted between the shells. The shells each have a tab projecting from the closed end, the tabs being secured together and providing an elastic hinge which urges the shells together so that the inside of the shells frictionally grip the finger of the user. The tabs project longitudinally beyond the closed end of the holder to provide a projection for mounting an applicator element or pad on the shells. The applicator pad is preferably mounted on a mounting element separate from the shells and in the form of a support which extends into the pad, and this mounting element has an opening to permit fitting the mounting element onto the tabs. The mounting element can be mounted on the tabs either permanently or removably, to permit changing the type of applicator element or to permit replacing the applicator element.

The applicator is preferably formed from a plastic material, for example, polystyrene, polyethylene or polypropylene. The mounting element which supports the applicator element is preferably semi-rigid, so it has some flexibility, to avoid accidental injury to the user especially when the applicator is used to apply makeup in the region of the eyes of the user.

The applicator of this invention can be used to apply a cosmetic product to the skin, on the lips, on the eyelashes and eyebrows, and can even be used to apply nail polish. Hence, depending on its use, the applicator element or pad will take the form of a brush, sponge, foam mass, felt body, or any other desired type of applicator element.

Where the applicator element takes the form of a flat pad, for example, of foam, the mounting element is also flat and fits within the pad to add some stiffness to the pad for better control of the application of makeup. The mounting element itself is, of course, somewhat flexible so the pad will give or flex somewhat in use.

In accordance with one embodiment of the mounting element, the mounting element includes an enlarged body portion, with a thin flexible and preferably resilient tip integral with the body. The body converges toward the tip to provide a convex surface between the end of the tip and a base of the body remote from the tip. An applicator element in the form of a soft material cover pad is stretched over the region between the tip and end of the body and its suppleness or resiliency is enhanced by the absence of material of the mounting element in the region of the concave surfaces.

In all the embodiments the holder and applicator element are so arranged that the applicator element is spaced from the tip of the finger of the user.

Correspondingly, an object of this invention is a makeup applicator to be mounted on one's finger, which effectively protects the finger against being soiled by the makeup or cosmetic, and which provides its applicator element at a distance from the tip of the finger on which the applicator is mounted, wherein either the makeup applicator element or the entire assembly of holder and applicator element is disposable, and in which the construction of the makeup applicator is relatively inexpensive, yet convenient and effective in use.

Additional objects, features and advantages of the invention will become apparent with reference to the accompanying drawings and the detailed description of the preferred embodiment which follows.

BRIEF DESCRIPTION OF THE DRAWINGS

FIG. 1 is an exploded view in elevation of the makeup applicator according to the invention;

FIG. 2 is an exploded plan view of the applicator of FIG. 1;

FIG. 3 is a plan view of the assembled applicator;

FIG. 4 is a view in section taken along line 4—4 of FIG. 3;

FIG. 5 is a rear or left-hand end view of the applicator;

FIG. 6 is a front or right-hand end view of the applicator;

FIG. 7 is a rear or left-hand end view of the applicator mounting element;

FIG. 8 is a view in elevation showing the applicator element mounted on the finger of the user;

FIG. 9 is an exploded view in plan showing a second embodiment of mounting element and applicator element;

FIG. 10 is an exploded view in elevation of the embodiment of FIG. 9;

FIG. 11 is a front view of the applicator element of FIG. 10;

FIG. 12 is an exploded view of another embodiment of mounting element and applicator element; and FIG. 13 is a view in elevation of another embodiment of applicator and mounting element.

DETAILED DESCRIPTION OF PREFERRED EMBODIMENTS

FIGS. 1 through 7 show a first preferred embodiment of this invention. As shown, the applicator 10 comprises an applicator element 12, an applicator mounting element 13, and an applicator body or holder 14. Holder 14 takes the form of a hollow oval shell which has a substantially closed forward end 15. As is evident from FIGS. 3 and 4, the holder 14 has a generally elliptical outline and is wider than it is high.

Holder 14 is of two piece construction and is formed from two arcuate half-shells 17 and 18, these shells being identical, and shell 17 being shell 18 inverted. Each shell has a rounded converging front end portion 19 and a flat integral tab centrally located at the front of the shell and which projects forwardly from the shell. Each tab 20 is generally rectangular and projects beyond the front wall of the shell.

One side of each shell has a generally curved convex edge 22 whereas the other side of each shell has a generally curved concave edge 24 of identical curvature so that the two shells when assembled are split along curved lines at the sides of holder 14. These curved opposed edges enhance the attractiveness of the applicator and function to diminish the likelihood of soiling the user's finger when the applicator is placed on the user's finger as shown at FIG. 8.

Each body shell is formed from a relatively rigid material such as molded polystyrene or polypropylene. While this material is characterized as rigid or stiff, it will be appreciated that the narrower tabs 20 as well as the junction 26 where the tabs join the respective shells form regions of increased flexibliity for providing a resilient hinge between the shell halves 17 and 18.

Mounting element 13 includes a body portion 28 with a base 29. Body 28 converges in a direction away from base 29, and has a relatively thin flat integral tip 30. The tip 30 has a length approximately equal to the length of the body 28 and extends to the regions 31 at the sides of the body.

Mounting element 13 is molded from a plastic material which has greater resiliency than the plastic material of shells 17, 18. Correspondingly, the thin tip 30 is relatively flexible and resilient. As is evident from FIG. 1, there is a concave region 32 between the extreme end of tip 30 and base 29 of mounting element 13.

Applicator element 12 takes the form of a cover of uniform wall thickness having a closed end or tip 35 and an open end 36. Applicator element 12 can be formed from a woven or nonwoven fabric, preferably one which is somewhat resilient, such as polyurethane foam or a very small pore sponge material. The relaxed size of opening 36 is preferably slightly smaller than the size of base 29 of mounting element 13. The relaxed length of applicator element 12 can be essentially the same as the length of the mounting element from base 29 to the end of tip 30. To mount the applicator element 12 on mounting element 13, the applicator element is stretched over the mounting element and is adhered or bonded to the body 28 of the mounting element at a region 38 (FIG. 4) near the base 29 of the mounting element. As a result, a region 40 of the applicator element between tip 30 and base 29 of the mounting element is spaced from the opposed concave surfaces 32 of the mounting element, and the softness or resiliency of the applicator element in this region 40 is enhanced. The flexibility of tip 30 of the mounting element cooperates with the softness of the pad to prevent injury to the user, for example, when the applicator is used to apply makeup in the region of the eyes.

As shown at FIG. 7, body 28 of mounting element 13 has a rectangular opening therein extending from its base 29, this opening 42 being of a size preferably very slightly smaller than the combined thickness of tabs 20 of holder 14 so that the mounting element is frictionally received on the tabs.

Shell halves 17 and 18 are secured together by adhering or bonding tabs 20 together at the front of the holder. Such bonding can be accomplished by heat sealing or by an adhesive. Preferably, only the front half of the tabs are bonded together in the region 44 and the remaining portions of each tab between bonded portion 44 and the point of connection 26 with the shell halves remains unbonded. By virtue of this arrangement, a portion of the length of each tab contributes to the resiliency of the hinge connection provided by the tabs. The mounting element 13 because of its close fit on the tabs, and because of its elasticity, serves further as a reinforcement for the tabs to enhance the resiliency of the hinge action which occurs when the finger of the user is inserted between the shells. In this manner, the mounting element also reinforces the relatively thin tabs 20 and causes them to resist breakage when the shells are inadvertently spread too far apart.

Mounting element 13 can be secured to the tabs with an adhesive so that the entire applicator including holder 14, mounting element 13, and applicator element 12 is disposable Alternatively, the assembly of mounting element 13 and applicator element 12 can simply be friction fit on tabs 20, this arrangement permitting replacing the assembly of applicator element and mounting element on holder 14.

As shown at FIG. 8, the forward end of holder 14 while hollow, is of a dimension smaller than the size of a person's finger tip so that the finger 45 of the user, on which applicator assembly 10 is mounted, cannot be pushed against the front of the holder. It is preferred that the tip of the finger be spaced approximately one-half the length of the holder 14 from the front of the holder. By virtue of such dimensioning, the applicator element 12 is spaced from the finger tip 46 to form in effect an extension of the finger but which is spaced from the finger tip by a distance of, for example, approximately one inch. This arrangement permits use of the applicator element 12 in a manner similar to the previously used handle type applicators, and thus presents no inconvenience for ladies who are accustomed to applying makeup with an applicator spaced from the tips of the fingers which grip its handle. In addition, by dimensioning the holder 14 so that the finger can be inserted only partially into the body, this applicator can be used conveniently by women with relatively long fingernails.

FIGS. 9–11 show a second embodiment of mounting element and applicator element. Mounting element 50 is similar to mounting element 13 in that it includes a body 52 with an integral resilient projecting tip 54. The configuration of the mounting element 50 is somewhat different. Tip 54 is shorter and broader than tip 30 of mounting element 13. In addition, body 52 generally takes the shape of a cone which is more flattened as viewed in elevation at FIG. 10 than the body 28 of mounting element 13 which is more conical. There is of course a rectangular opening-like opening 42 in the base of mounting element 52.

Applicator element 56 of FIGS. 9–11 takes the form of a thin wall cover of material which is soft and/or resilient. Applicator element 56 is formed from two different materials, and has an upper pad portion 58 of one material and a lower pad portion 60 of a different material, and which is joined to portion 58 along a seam or joint 62. This seam can be stitched, formed by adhesive, or formed by heat sealing the portions 58 and 60 together along the seam which lies in the plane of tip 54 of mounting element 50. Upper portion 58 can for example take the form of a sponge pad while lower portion 60 can be a soft fabric. This permits use of the portion 58 to apply the cosmetic, and use of the portion 60 to blend the cosmetic evenly on the face of the user. Applicator element 56 can be stretched onto mounting element 50 and adhesively secured to the mounting element in the region near base 64 of the mounting element 50. The softness of pad portions 58 and 60 which cover opposed concave surfaces 66 of mounting element 50 is again enhanced by spacing these portions from the concave surfaces.

To enhance the versatility of the makeup applicator, mounting elements such as those shown in FIGS. 12 and 13 can be provided. In FIG. 12, mounting element 70 has a tip in the form of a shaft 72 to receive a sleeve 74 thereon, sleeve 74 carrying a brush 76. Alternatively, as shown at FIG. 13, a mounting element 78 can be molded with a hollow tip 80 to receive a tulip shaped applicator element 82 of foam material, which can be cemented in the opening 84 of sleeve portion 80.

While a preferred embodiment of the applicator according to this invention has been shown and described, and while several embodiments of applicator element and mounting element are shown and described, it will be appreciated that numerous changes can be made without departing from the scope of this invention.

What is claimed is:

1. A makeup applicator for mounting on a finger of the user comprising, a holder assembly formed from a semi-rigid material and comprising first and second elongate shell portions in opposed relation to each other, said shells presenting a substantially closed end, each of said shells opening in a direction away from said tip to receive between and within the shells a finger of the user, each shell having an integral tab substantially narrower than its shell and projecting longitudinally beyond the closed end thereof to provide a projection, mounting means adjacent the end of the shells for mounting an applicator element on said holder assembly and being received on the projection of said tabs, said tabs having resilient characteristics to provide an elastic hinge means that urges the shells together so that the inside of the shells frictionally grip the finger of the user, and an applicator element fitted to said mounting means, said shell portions being dimensioned to receive the finger of the user longitudinally therein so that the tip of the finger is substantially spaced longitudinally from said end, said hinge means frictionally retaining the holder on the user's finger to permit maintaining the applicator on the finger of the user with said applicator element spaced at a convenient distance from the user's fingertip to enable easily applying a cosmetic product.

2. A makeup applicator according to claim 1 wherein said mounting element comprises an enlarged body having a thin flexible tip, and said applicator element comprises a hollow pad extending over said tip.

3. A makeup applicator according to claim 2 wherein said mounting element comprises a concave surface between said body and said tip, and said pad comprises a cover of flexible material supported by said tip and said body and spaced from said concave surface to enhance the flexibility of the pad in the region of the concave surface.

4. A makeup applicator according to claim 1 wherein each arcuate shell portion comprises a shell of thin flexible plastic material diverging from said hinge means, said hinge means connects said shell portions together, and the holder formed by said arcuate shells has a relaxed inside dimension less than the diameter of the user's finger, so that the holder is frictionally held on the user's finger by virtue of resilient deformation of the holder as it is pushed on the finger of the user.

5. A makeup applicator according to claim 1 wherein the arcuate shells of the holder are each chemically inert to the cosmetic with which the applicator is used.

6. A makeup applicator according to claim 1 wherein said shell portions comprise separate arcuate shell portions, and said hinge means connect said shell portions together.

7. A makeup applicator according to claim 6 wherein each shell portion comprises, a shell portion having a flat longitudinally projecting tab, and means bonding said tabs together.

8. An applicator according to claim 6 wherein said mounting means comprises, a mounting element having an opening into which a portion of said tabs extend, and means securing said applicator element to said mounting element.

9. A makeup applicator according to claim 1 wherein said applicator element comprises, a hollow pad having a closed end and sides and an open end, said closed end covering the mounting means.

10. A makeup applicator according to claim 1 wherein said mounting means reinforces said tabs and resists separation thereof.

* * * * *